US011598171B2

(12) United States Patent
Matthews

(10) Patent No.: US 11,598,171 B2
(45) Date of Patent: Mar. 7, 2023

(54) TUBING STRING WITH AGITATOR, TUBING DRIFT HAMMER TOOL, AND RELATED METHODS

(71) Applicant: COMPLETE DIRECTIONAL SERVICES LTD., Eckville (CA)

(72) Inventor: Shane Matthews, Eckville (CA)

(73) Assignee: COMPLETE DIRECTIONAL SERVICES LTD., Eckville (CA)

( * ) Notice: Subject to any disclaimer, the term of this patent is extended or adjusted under 35 U.S.C. 154(b) by 0 days.

(21) Appl. No.: 17/035,659

(22) Filed: Sep. 28, 2020

(65) Prior Publication Data

US 2021/0095539 A1 Apr. 1, 2021

(51) Int. Cl.

| | |
|---|---|
| ***E21B 31/00*** | (2006.01) |
| ***E21B 7/04*** | (2006.01) |
| ***E21B 47/09*** | (2012.01) |
| ***E21B 7/24*** | (2006.01) |
| ***E21B 17/04*** | (2006.01) |

(52) U.S. Cl.

CPC ..... *E21B 31/005* (2013.01); *E21B 7/046* (2013.01); *E21B 7/24* (2013.01); *E21B 17/041* (2020.05); *E21B 47/09* (2013.01)

(58) Field of Classification Search

CPC ..... E21B 31/005; E21B 17/041; E21B 7/24; E21B 7/046; E21B 47/09

See application file for complete search history.

(56) References Cited

U.S. PATENT DOCUMENTS

| | | | | |
|---|---|---|---|---|
| 4,211,121 | A | 7/1980 | Brown | |
| 4,611,374 | A * | 9/1986 | Schnelle | B23P 11/005 29/445 |
| 4,890,682 | A * | 1/1990 | Worrall | E21B 31/113 175/298 |
| 5,957,220 | A * | 9/1999 | Coffman | E21B 4/02 173/79 |
| 7,017,681 | B2 * | 3/2006 | Ivannikov | E21B 7/24 175/297 |
| 3,011,427 | A1 | 9/2011 | Shoyhetman et al. | |
| 3,061,053 | A1 | 11/2011 | Gillan | |
| 8,695,696 | B2 | 4/2014 | Shoyhetman et al. | |
| 9,175,535 | B2 * | 11/2015 | Gregory | E21B 4/02 |
| 9,598,923 | B2 | 3/2017 | Gilleylen et al. | |
| 9,726,004 | B2 * | 8/2017 | Echols, III | E21B 47/092 |
| 11,261,685 | B2 * | 3/2022 | Samuel | E21B 4/04 |

(Continued)

OTHER PUBLICATIONS

Peak Well Systems, FlexiDrift, believed to be available as early as May 26, 2015, 1 page.

(Continued)

*Primary Examiner* — Jonathan Malikasim

(74) *Attorney, Agent, or Firm* — Robert A. Nissen

(57) ABSTRACT

A tubing string, such as a coiled tubing or jointed tubing string, has an agitator mounted within an interior of the tubing string at an intermediate position between an uphole end and a downhole end of the tubing string. A tubing agitator is structured to be installed within a tubing string. A method includes: forming or installing a seat within an interior of a tubing string at an intermediate position between an uphole end and a downhole end of the tubing string; and conveying an agitator through the interior of the tubing string until the agitator contacts the seat. A hammer drift tool is also described.

11 Claims, 4 Drawing Sheets

(56) References Cited

U.S. PATENT DOCUMENTS

| | | | | |
|---|---|---|---|---|
| 2008/0251254 | A1* | 10/2008 | Lynde | E21B 31/005 166/301 |
| 2012/0048619 | A1 | 3/2012 | Seutter et al. | |
| 2014/0102804 | A1 | 4/2014 | Cote | |
| 2016/0130898 | A1 | 5/2016 | Solem | |
| 2019/0032432 | A1 | 1/2019 | Sommer | |
| 2019/0100986 | A1 | 4/2019 | Glasgow et al. | |
| 2021/0215469 | A1* | 7/2021 | Bomersbach | E21B 23/08 |
| 2021/0404291 | A1* | 12/2021 | Quero | E21B 34/10 |

OTHER PUBLICATIONS

Precision Microdrives, Understanding ERM Vibration Motor Characteristics, accessed May 13, 2019, 7 pages, URL=https://www.precisionmicrodrives.com/content/ab-004-understanding-erm-vibration-motor-characteristics/.

Wikipedia, Actuator, accessed May 13, 2019, 6 pages, URL=https://en.wikipedia.org/wiki/Actuator.

Wikipedia, Coiled tubing, accessed May 8, 2019, 4 pages, URL=https://en.wikipedia.org/wiki/Coiled_tubing.

Wikipedia, Coiled tubing drilling, accessed May 8, 2019, 3 pages, URL=https://en.wikipedia.org/wiki/Coiled_tubing_drilling.

Oilfield Glossary, Drift, accessed May 6, 2019, 1 page, URL=https://www.glossary.oilfield.slb.com/Terms/d/drift.aspx.

Botta Equipment, Drift, accessed May 8, 2019, 3 pages, URL=http://www.botta-equipment.com/content/catalog/drift.

Precision Microdrives, Eccentric Rotating Mass Vibration Motors—ERMs, accessed May 13, 2019, 4 pages, URL=https://www precisionmicrodrives.com/vibration-motors/eccentric-rotating-mass-vibration-motors-erms/.

Exwell Oilfield, Exwell Tubing Drift, accessed May 8, 2019, 2 pages, URL=https://exwelloilfield.com/os_wirelinetool/wt_tubingDrift.html.

Oilfield Glossary, Horizontal drilling, accessed May 8, 2019, 1 page, URL=https://www.glossary.oilfield.slb.com/Terms/h/horizontal_drilling.aspx.

National Oilwell Varco, i-Drift, accessed May 8, 2019, 2 pages, URL=https://web.archive.org/web/20181129192911/https://www.nov.com/Segments/Completion_and_Production_Solutions/Completion_Tools/Intervention/Wireline/i-Drift.aspx.

Oilenco, OneDrift, accessed May 8, 2019, 8 pages, URL=https://www.oilenco.com/products/onedrift/.

Wikipedia, Rotating unbalance, accessed May 13, 2019, 4 pages, URL=https://en.wikipedia.org/wiki/Rotating_unbalance.

Upside Energy Services, Drift Tools, accessed May 8, 2019, 1 page, URL=http://www.upsideenergy.com/drift_tools.htm.

Nikipedia, List of components of oil drilling rigs, accessed Jun. 18, 2018, 2 pages, URL=https://en.wikipedia.org/wiki/List_of_components_of_oil_drilling_rigs.

Omega Intervention, Drop Bar, available as early as Feb. 5, 2020, 2 pages.

Omega Intervention, Wireline Products Releasable Rope Socket/Drop Bar, available as early as Aug. 3, 2018, 3 pages, URL=http://www omega-intervention.com/index.php/products/wireline/releasable-rope-socket.

Brace Tool, Wireline Fishing Tools, available as early as Aug. 3, 2018, 6 pages, URL=https://www.bracetool.com/definition/426/wireline-fishing-tools.

Brace Tool, Wireline Equipment, available as early as Aug. 3, 2018, 6 pages, URL=https://www.bracetool.com/definition/415/wireline-equipment.

Omega Intervention, Releasable Rope Socket, available as early as Feb. 5, 2020, 2 pages.

Grifco, Pulling Tool for External Fishing Necks, accessed Jun. 21, 2018 but available at least as early as Aug. 16, 2018, 2 pages, URL=http://www.grifco-oiltools.com/products/pullingtoolforexternalfishingnecks.htm.

Shultz, Vibratory Downhole Tool Technologies with Application to Horizontal Drilling and Casing Installation, available as early as Feb. 2013, 21 pages, TTS Drilling Solutions.

Youtube, Screenshot of Basket Grapple Overshot, accessed Oct. 7, 2019 but available as early as May 2, 2014, 2 pages, URL=https://www.youtube.com/watch?v=EIUTUJJ8L7M.

RX Wireline Tools, Slip Rope Socket, accessed Aug. 3, 2018 but available as early as Apr. 18, 2018, 2 pages, screenshot from Wayback Machine, URL=https://web.archive.org/web/20180418002741/http://www.rxwirelinetools.com/wireline-tool-string/slip-rope-socket.html.

* cited by examiner

TUBING STRING WITH AGITATOR, TUBING DRIFT HAMMER TOOL, AND RELATED METHODS

TECHNICAL FIELD

This document relates to tubing, such as agitators and drift tools for tubing, as well as related methods of use, such as methods of install and operation.

BACKGROUND

Agitators are used to reduce friction on the tubing string during drilling or workover operations. Drift tools are used to check the inner diameter of a tubing string.

SUMMARY

A tubing string is disclosed comprising an agitator mounted within an interior of the tubing string at an intermediate position between an uphole end and a downhole end of the tubing string.

In some cases a tubing agitator is disclosed structured to be installed within a tubing string.

A method is disclosed comprising: forming or installing a seat within an interior of a tubing string at an intermediate position between an uphole end and a downhole end of the tubing string; and conveying an agitator through the interior of the tubing string until the agitator contacts the seat.

A hammer drift tool is also disclosed comprising: an outer housing whose exterior surface defines a tubing diameter for which the hammer drift tool is sized; an inner mandrel disposed telescopically at least partially within the outer housing; cooperating jarring surfaces on the inner mandrel and outer housing for jarring contact with each other when fluid pressure is applied against the inner mandrel in a first direction; a restrictor for restricting initial movement of the inner mandrel relative to the outer housing when fluid f is applied to the inner mandrel in the first direction; and the hammer drift tool being structured to move, during use, in a second direction through tubing when fluid pressure is applied against the hammer drift tool in a second direction opposite the first direction.

In various embodiments, there may be included any one or more of the following features: The tubing string is a coiled tubing string or a jointed tubing string. An inner wall of the tubing string is indented to form a seat upon which the agitator sits. The tubing string is one or both crimped or dimpled to form the seat. The seat is an uphole facing seat; the inner wall of the tubing string is indented to form a downhole facing seat; and the agitator is retained between the uphole facing seat and the downhole facing seat. An outer housing of the agitator contacts the seat in use. The outer housing comprises a sleeve that defines an exterior of the outer housing, in which an outer diameter of the sleeve narrows at an intermediate cylindrical portion of the sleeve. The agitator is a fluid-actuated agitator. The agitator defines a fluid passageway between an uphole end and a downhole end of the agitator; and the agitator has a motor that rotates and vibrates under flow through the fluid passageway. The motor is connected to rotate a weighted cam. The motor comprises a turbine. The agitator comprises a compressible element that supports the motor and compresses under fluid flow through the agitator in a downhole direction. The agitator comprises a thrust bearing assembly that supports the motor. A plurality of agitators mounted and spaced from one another within the interior of the tubing string at different respective intermediate positions along at least a portion of a longitudinal length of the tubing string. The tubing string disposed below ground within a well that penetrates a formation within the earth. The tubing string forming a drilling string. A method of operating the tubing string within the well, for example to service, drill, ream, or complete the well. The agitator is located within a horizontal or deviated part of the well. After the agitator is conveyed to the seat, forming or installing a second seat within the interior of the tubing string to retain the agitator between the first seat and the second seat. Forming the seat is accomplished by one or both crimping and dimpling an exterior of the tubing string. Using an agitator position sensor to confirm that the agitator is in the intermediate position. The agitator position sensor comprises a sonic meter. Conveying comprises applying fluid pressure in a first direction within the interior of the tubing string. Conveying comprises applying fluid pressure against a ball or plug positioned upstream of the agitator. Prior to forming or installing the seat, passing a drift tool through the interior to confirm a drift inner diameter of the tubing string. In which conveying further comprises applying fluid pressure in a first direction within the interior of the tubing string; in which the drift tool forms ajar; and comprising, if the drift tool becomes stuck within the interior, applying fluid pressure in a second direction, opposite the first direction, within the interior of the tubing string to cause the jar to initiate a jarring action. After the jarring action, applying fluid pressure in the first direction within the interior of the tubing string to reset the jar. Conveying the agitator is carried out while the tubing string is above a ground surface. Inserting the tubing string within a well that penetrates a formation within the earth. Using the tubing string to drill or ream the well. The tubing string is moved sufficiently down the well to position the agitator within a horizontal or deviated part of the well. The inner mandrel is disposed telescopically at least partially within a passageway in the outer housing, and the passageway is sealed against fluid flow therethrough. The restrictor is structured to reset when fluid flow is applied against the inner mandrel in the second direction after jarring contact between the cooperating jarring surfaces. The restrictor comprises a lock that is structured to release the inner mandrel upon application of fluid pressure in the first direction against the inner mandrel over a predetermined threshold pressure. The predetermined threshold pressure is 200 psi (pounds per square inch). The predetermined threshold pressure is between 50 and 500 psi. The restrictor comprises a male part, on one of the outer housing or inner mandrel, that is biased into contact with a female part, on the other of the outer housing or inner mandrel, when the inner mandrel is in a set position prior to ajar movement. The male part comprises a pin or a ball that is biased within a radial slot in the outer housing into contact with a pin or ball indent in the inner mandrel when the inner mandrel is in the set position. The pin or ball indent comprises a circumferential groove in an outer surface of the inner mandrel. The restrictor comprises a shear pin. A piston shaft of the inner mandrel is disposed telescopically at least partially within a passageway in the outer housing, with opposed ends of the piston shaft having mounted thereon respective flanges to retain the piston shaft for limited non-zero axial movement within the passageway. One or both of the respective flanges comprises a nut threaded to a respective one of the opposed ends. One of the respective flanges forms a respective jarring surface of the cooperating jarring surfaces. An inner wall of the passageway forms a bypass to permit fluid pressure in the second direction to act against the respective jarring surface of the one of the respective flanges to reset the inner mandrel from a jarred position with the cooperating jarring surfaces in contact with one another into a set position. The bypass is defined by scalloping about an inner circumference of the outer housing. Drifting the hammer drift tool through an interior of a tubing string to confirm or enlarge a minimum inner diameter of the tubing string. In which drifting comprises applying fluid pressure against the hammer drift tool in the second direction; and further comprising, if the hammer drift tool becomes stuck within the tubing string, applying fluid pressure against the hammer drift tool in the first direction to overcome the restrictor and initiate a jarring contact between the cooperating jarring surfaces. Resetting the hammer drift tool after jarring contact by applying fluid pressure against the hammer drift tool in the second direction. Positioning the agitator within the tubing string comprises positioning a ball at a downhole end of the agitator. The ball is removed prior to indenting the downhole end of the intermediate axial portion. Positioning the tubing string within a well that penetrates a formation within the earth, with the agitator positioned within a horizontal or deviated part of the well.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Figure 1:
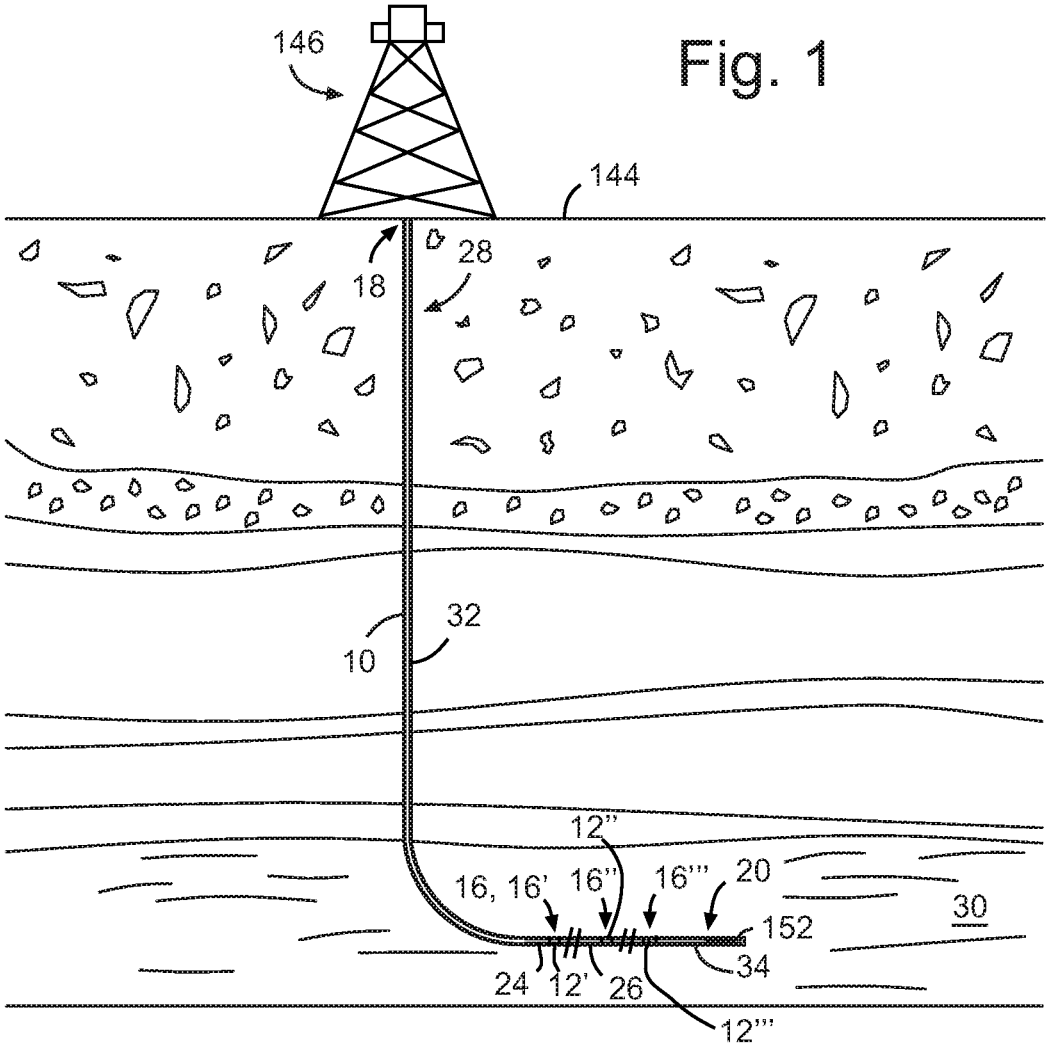
FIG. 1 is a side elevation view of a coiled tubing string within a well that penetrates a formation within the earth.

Immaterial modifications may be made to the embodiments described here without departing from what is covered by the claims.

In the oil and gas industry, coiled tubing refers to a continuous metal pipe that is stored in a spooled state on a reel. Common coiled tubing strings may be 1 to 3.25 inches in inner diameter (or other suitable inner diameters), with yield strengths ranging from 55,000 to 120,000 pound per square inch (psi). Coiled tubing may be used as production tubing or to perform various well operations such as well servicing, well interventions, operations similar to wire lining, work-over operations, open hole drilling and milling operations, and reservoir fracturing. Coiled tubing may be used in place of jointed tubing, requiring relatively less effort and expense to trip in and out of the well since the coiled tubing can be run in and pulled out in contrast to jointed tubing, which must be assembled and dismantled joint by joint while tripping in and out. Coiled tubing may also be used to drill, ream, or complete a well. Coiled tubing may support a variety of bottom hole assemblies, such as a jetting nozzle, a logging tool, a drill bit and/or a mud motor. Coiled tubing may be run from a drilling derrick, using a service rig, or from a mobile self-contained trailer-mounted coiled tubing rig.

In today's oil and gas production and exploration industry, most wells are drilled into horizontal wells, which more effectively penetrate and access the relatively horizontal oil and gas bearing strata layers under the Earth's surface than is possible with conventional vertical wells. A horizontal well may offer a significant production improvement over a vertical well, due to the fact that a horizontal well typically penetrates a relatively greater length of the reservoir.

During well exploration, particularly horizontal drilling operations, contact between a drill string and a wellbore may generate frictional forces, leading to restrictive torque and drag. Torque and drag may result in low rates of penetration, poor tool face control, short runs, and severe drill string and bit wear, for example when running casing, liners, and during completions. High tortuosity can lead to higher friction during running in hole operations for both drilling and completion tubing strings. Contact between a drill string and a wellbore may be caused by string buckling, deformed coiled tubing, deviated wellbore lines, gravitational forces acting on the drill string in the horizontal section of the well, and hydraulic loading against the wellbore. Sand and debris in the wellbore may exacerbate the amount of friction generated by such contact. In a horizontal or deviated well, there is relatively less vertical weight available to overcome friction in the lateral part of the wellbore than available in a vertical well, and more friction is produced from contact between steel coiled tubing and steel casing relative to contact between steel drill string or casing and formation rock. In addition, the challenge of horizontal well drilling with coiled tubing is exacerbated by the fact that relative to jointed tubing or casing, coiled tubing has lower buckling values. Despite the challenges of horizontal drilling with coiled tubing, there is a potential for a horizontal oil well to be drilled and cased deeper and further than is possible with conventional coiled tubing drilling processes and systems.

Agitator tools, for example rotary valve pulse tools, oscillatory flow-modulation tools, and poppet/spring-mass tools, may be attached to the downhole end of a coil tubing string to induce vibrations in the coiled tubing during use. Controlled vibrations may reduce the build-up of solid materials around the coiled tubing, reduce friction and stick slip, prevent the coiled tubing from becoming stuck in the well, improve rates of penetration, and extend the operating range and measured depth achievable by a drilling assembly.

Vibration may be generated by imparting unbalanced forces upon the coiled tubing, whether by reciprocation (such as repeated extension and contraction of the coiled tubing), rotation of a cam, oscillating fluid movement, and by other mechanisms, all of which work to break or negate the effect of static friction between tubing and the wellbore. Rotary valve pulse tools may be used with a rotor mounted in a stator and connected to a valve, which may be structured to temporarily disrupt fluid flow to create and release fluid pressure within the tool. Oscillatory flow-modulation tools may create a specialized fluid path structured to create a varying flow resistance that functions similar to an opening and closing valve. Poppet/spring-mass tools may incorporate a sliding mass, a valve, and spring components that oscillate in response to flow through the tool. Such mechanisms may create a mechanical hammering and/or flow interruption.

Figure 6A:
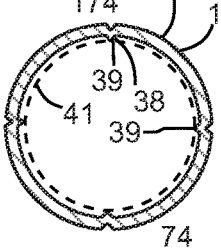
FIG. 6A is a cross-section view taken along the 5-5 section lines of FIG. 5, showing only the coiled tubing string, illustrating the string being indented with dimples, and with dashed lines used to indicate an example shape of a circumferential groove indent if one were created.
Figure 6:
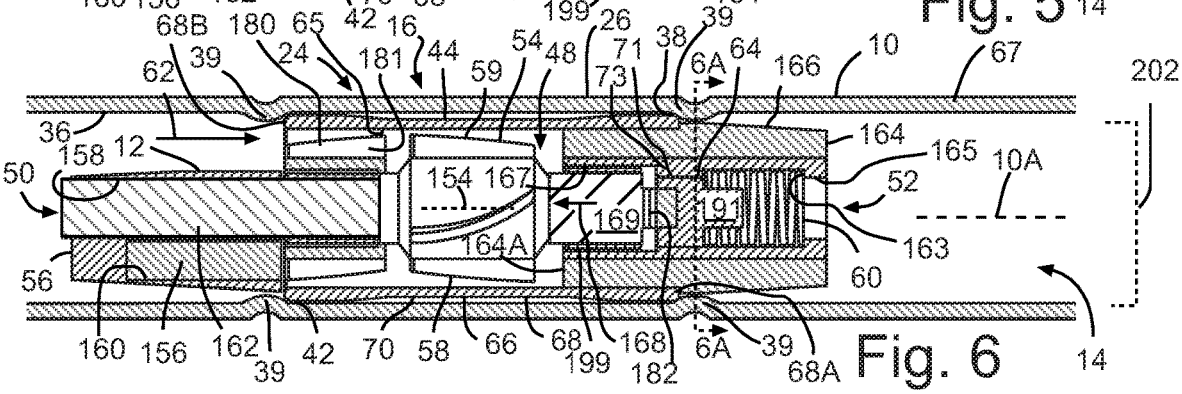
Figure 9:
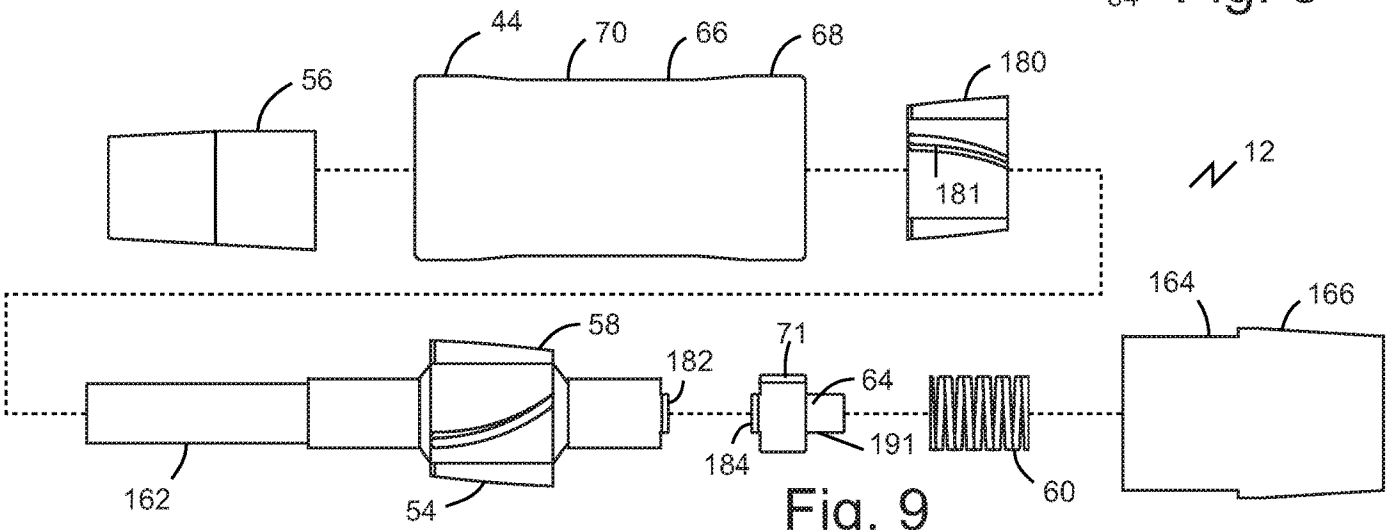
FIG. 9 is an exploded view of the agitator of FIG. 5.
Figure 10:
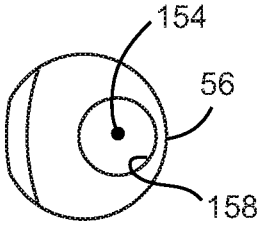
FIG. 10 is a first end view of a weighted cam of the agitator of FIG. 5.
Figure 11:
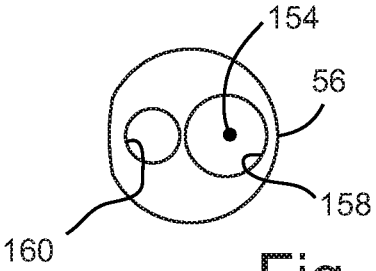
FIG. 11 is a second end view of a weighted cam of the agitator of FIG. 5.

Referring to FIGS. 6 and 9, an agitator 12 is illustrated. Referring to FIGS. 1 and 6, a coiled tubing string 10 may comprise the agitator 12 (FIG. 6), for example mounted within an interior 14 (FIG. 6) of the coiled tubing string 10 at an intermediate position 16 between an uphole end 18 and a downhole end 20 of the coiled tubing string 10. Mounting the agitator 12 within the interior 14 may refer to the fact that the agitator is mounted within the continuous unbroken portion of a string of coiled tubing, as opposed to being mounted at an end of a coiled tubing segment, or at a joint between adjacent coiled tubing segments. The coiled tubing string 10 may incorporate a plurality of the agitators 12. The plurality of the agitators 12 may be mounted and spaced from one another within the interior 14 of the continuous coiled tubing string 10 at different respective intermediate positions such as positions 16',16", and 16''', for example along at least a portion 24 of a longitudinal length 26 of the coiled tubing string 10. In some cases the agitators 12 are mounted along the entire or a substantial portion of the length 26 of the string 10. In some cases the agitators 12 are mounted in the deviated portion 34 of the well 28. The coiled tubing string 10 may be disposed below ground in use, for example below a ground surface 144, within a well 28 that penetrates a formation 30 within the earth. The coiled tubing string 10 may form a drilling string 32, for example having a drill bit 152, jet drill assembly, or other drilling tools suitable to bore through the earth.

Referring to FIG. 6, the coiled tubing string 10 may be structured to retain the agitator 12 in position. An inner wall 36 of the coiled tubing string 10 may be indented to form a seat 38 upon which the agitator 12 sits. The coiled tubing string 10 may be one or both crimped or dimpled to form the seat 38, for example via a device that can deliver at least 20 tons of force. A hydraulic or other suitable crimping or dimpling tool (such as a clamp) may be used to indent the string 10. Referring to FIG. 6A, a crimping tool may form an indent such as a circumferential or partially circumferential arcuate groove 41 (shown in dashed lines). A dimpling tool (such as incorporating a dimple die) may form a dimple, such as a bulbous point indent 39 as opposed to a groove 41. Indenting may be achieved by applying a deforming force in a radial direction against an exterior surface 67 of the coiled tubing string 10, to bend or otherwise deform the string 10 inward at the point of the indent. Referring to FIGS. 6 and 6A, a seat 38 may be formed by a plurality of dimples or crimps, such as four dimple indents 39 spaced about an inner circumference of the string 10 at position 16, or another suitable number of dimple indents, such as two, three, five, or more. Preferentially the dimples will be located on the neutral axis, 90° to the bend axis. Referring to FIG. 6, the seat 38 may form an uphole facing shoulder or seat 38. The indents may be formed as reversible indents whose shape may be reversed to repair the string 10 after the agitators 12 have served their purpose and are to be removed.

Referring to FIG. 6, the inner wall 36 of the coiled tubing string 10 may retain the agitator 12 between opposed seats. The inner wall 36 may be indented to form a downhole facing seat 42. The indenting that is used for seat 42 may incorporate any of the features of the indenting used for seat 38, and in the example shown four dimple indents 39 are used to form seat 42. The seats 38 and 42 may be formed by different methods and with different structures from one another. The agitator 12 may be seated for example retained between the uphole facing seat 38 and the downhole facing seat 42. The uphole facing seat 38 and the downhole facing seat 42 may collectively restrict both uphole and downhole movement of the agitator 12, restricting the agitator 12 to axial movements (if any movement is possible) only between the seats 38 and 42, with axial movements referring to movements along a central axis 10A of the string 10. The uphole facing seat 38 and the downhole facing seat 42 may retain the agitator 12 inside the coiled tubing string 10 during use, to prevent the agitator 12 from moving out of position 16.

Referring to FIG. 6, the agitator 12 may have an outer housing 44, such as a sleeve 68, that has a suitable structure for housing and supporting the parts of the agitator 12 within the tubing string 10. The sleeve 68 may in use contact the seat 38. The sleeve 68 may in use contact uphole and downhole seats 38 and seat 42, for example via downhole and uphole ends 68A and 68B, respectively of the sleeve 68. Referring to FIGS. 6 and 9, an exterior 66 of the sleeve 68/outer housing 44, may narrow in diameter at an intermediate cylindrical portion 70 of the sleeve 68, forming a concavity. In some cases the sleeve 68 tapers inward in diameter when moving from ends 68A and 68B toward a longitudinal center of the sleeve 68. Such a shape of the sleeve 68, for example an hour glass or spool shape, may permit the coiled tubing string 10 to be retracted onto the reel unit without negatively impacting the reeling process. Such a shape may also reduce friction between the agitator 12 and the inner wall 36 of the coiled tubing string 10 and thus improve placement of the agitator 12, potentially also reducing damage to the coiled tubing string 10 during installation of the agitator 12 within the coiled tubing string 10. By reducing damage the longevity and potential reusability of the coiled tubing string 10 with agitator 12 removed is increased.

Figure 12:
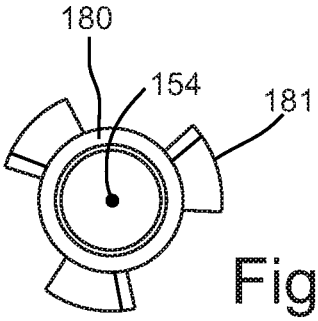
FIG. 12 is a view of an uphole end of a first turbine of the agitator of FIG. 5.
Figure 13:
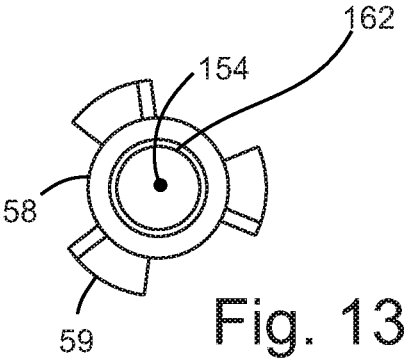
FIG. 13 is a view of an uphole end of a second turbine of the agitator of FIG. 5.

Referring to FIG. 6, the agitator 12 may be a fluid-actuated agitator. A fluid-actuated agitator may be any agitator having a part that uses fluid flow to facilitate mechanical motion, for example linear, rotatory, or oscillatory motion. The agitator 12 may define a fluid passageway 48 between an uphole end 50 and a downhole end 52 of the agitator 12. The passageway 48 may be structured to minimize drag on passing fluid, for example by reducing the cross-sectional flow area of the string 10 by only 80%, 70%, or less. The agitator 12 may have a motor 54 that rotates and vibrates under flow, for example liquid flow or gas flow, through the fluid passageway 48. The motor 54 may comprise a second set of vanes (not shown). Referring to FIGS. 6 and 12-13, the motor 54 may have a suitable structure such as that of a turbine 58, for example having a plurality of vanes 59. A turbine may form a propeller whose vanes are angled to induce rotation about axis 154.

Referring to FIGS. 6, and 9-11, the motor 54 may be connected to rotate a weighted cam 56, such as an eccentric weight, or other part suitable for inducing vibration when rotated. The weighted cam 56 may define an axial shaft-receiving bore 158 and an offset receptacle 160, for example containing a suitable weight such as a tungsten carbide weight 156 (FIG. 6) or in some cases a void. The use of receptacle 160 may allow tailoring of the vibration produced by the motor 54, for example by changing out different weights 156. An eccentric weight may form a part having a center of mass that is offset (out of alignment with) an axis 154 of rotation of a motor shaft 162. Other structures may be used such as a cam made of a single piece of material. Vibration of the motor 54 may permit the coiled tubing string 10 to be run 1,000 meters deeper or more into the well 28 relative to a string 10 that does not comprise the agitator 12 or agitators 12.

Figure 15:
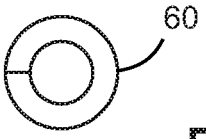
FIG. 15 is an end view of a compressible element of the agitator of FIG. 5.
Figure 16:
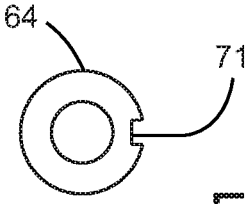
FIG. 16 is an end view of a thrust bearing assembly of the agitator of FIG. 5.

Referring to FIG. 6, the agitator 12 may have a structure suitable for supporting the motor 54. Referring to FIGS. 6, 9, and 15, the agitator 12 may comprise a compressible element 60 that supports the motor 54 and compresses under fluid flow through the agitator 12 in a downhole direction 62. Similarly, the element 60 may expand, in some cases to a neutral state, when fluid flow reduces in the downhole direction 62. Referring to FIG. 6, by permitting the agitator 12 to move against a compressible element such as a spring as shown, the agitator is protected against damage from hydraulic transients created during changes in fluid flow, as the element 60 exists to absorb transient energy from agitator 12.

Referring to FIG. 6, the agitator 12 may comprise one or more bearing assemblies, such as a thrust bearing assembly 64, that supports the motor 54. A downhole facing surface 182 of the motor 54 may seat, on an uphole facing surface 184 of the thrust bearing assembly 64. The thrust bearing assembly 64 may be structured to move axially, for example if mounted on compressible element 60 as shown, for example by receiving element 60 around an axial stem 191 of assembly 64. For example assembly 64 may be mounted to move in an uphole direction 168 when flow or pressure is stopped, to achieve a self-cleaning mechanism that dislodges and permits passage of any foreign debris that may be present in the circulating fluid or gas and trapped in the agitator 12. A radial bearing 199 may be present, such as a solid carbide radial bearing, which in the example shown is mounted within cylindrical receptacle 167. Other suitable bushing or bearings may be used to align the motor 54 for rotation and bear against rotation of the motor 54 relative to the rest of the agitator 12 and the string 10.

Figure 14:
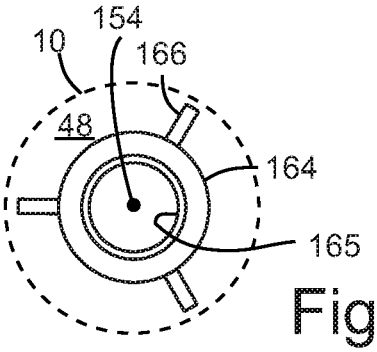
FIG. 14 is a view of a downhole end of a bearing housing of the agitator of FIG. 5, with the inner diameter of the coiled tubing string shown in dashed lines for reference.

Referring to FIG. 6, the thrust bearing assembly 64 and the compressible element 60 may be disposed and supported within a bearing housing 164 of the agitator 12. For example, the compressible element 60 may sit upon an uphole-facing seat 163 (for example a circumferential shelf) defined within an axial bore 165 of housing 164. Referring to FIGS. 6 and 14, the bearing housing 164 may have a plurality of centralizer vanes 166, for example that are structured to support and center the bearing housing 164 within the outer housing 44. The thrust bearing assembly 64 and bearing housing 164 may be structured to rotationally lock together. For example, mating splines 71 and 73 may be present on assembly 64 and housing 164 to prevent the assembly 64 from rotating relative to the housing 164. Conversely, by rotationally fixing the assembly 64, the assembly 64 will not rotate with the motor 54. An uphole end 164A of the housing 164 may define a cylindrical receptacle 167 for receiving and aligning a downhole shaft 169 that extends from the vanes 59 and defines the surface 182.

Referring to FIGS. 5, 6, 9, and 12, a bearing housing 180 may be mounted to support an uphole end or part of the motor 54. In the example shown the housing 180 supports shaft 162, for example to centralize the shaft 162 of the motor 54. The housing 180 may have centralizer vanes 181 to centralize the shaft 162 in the bore defined by an interior surface 65 of the housing 44. In the example shown the vanes 181 contact and mount within the interior surface 65 of the housing 44. The vanes 181 may be curved to direct fluids incoming from an uphole direction into a spiral flow such that fluids more effectively contact active faces 59A of vanes 59 of motor 54. In the example shown, vanes 181 are curved in a clockwise direction while moving along axis in a downhole direction. The curve or other angling of vanes 181 may be made in reverse to the orientation of the vanes 59 of motor 54, for example to provide smoother, improved flow and energy (power) transfer to motor 54. In the example shown vanes 59 curve or are angled in a counter clockwise direction while moving along axis in a downhole direction.

Figure 7:
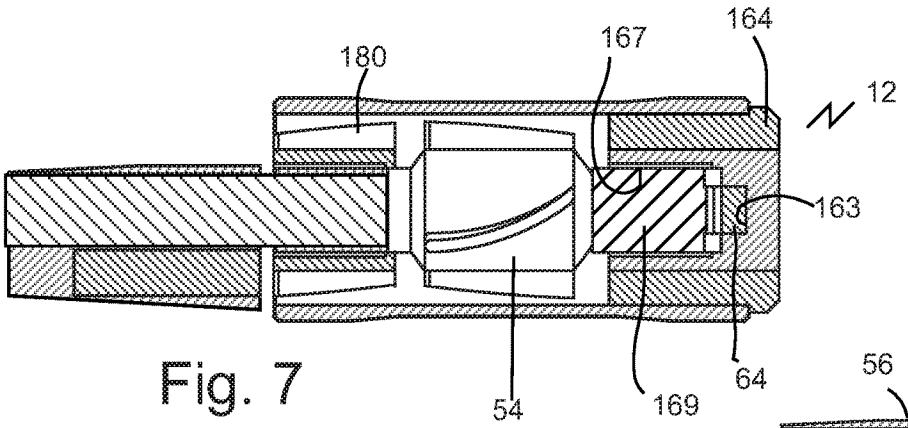
FIG. 7 is a partial cross-section view of another embodiment of an agitator, with a turbine of the agitator illustrated without sectioning.
Figure 8:
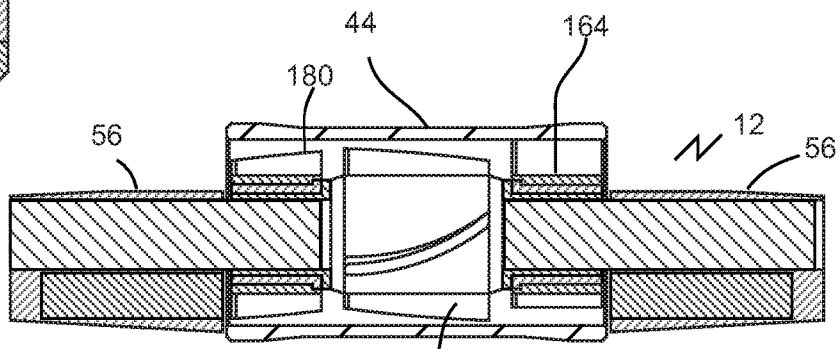
FIG. 8 is a partial cross-section view of another embodiment of an agitator, with a turbine of the agitator illustrated without sectioning, and one of the vanes illustrated in dashed lines.

Referring to FIGS. 7 and 8, two other embodiments of agitator 12 are illustrated. Referring to FIG. 7, an embodiment of an agitator 12 is illustrated lacking a compressible element 60. The uphole facing seat 163 that mounts the bearing assembly 64 may itself be a receptacle defined in an uphole facing end of cylindrical receptacle 167. Referring to FIG. 8, an agitator 12 is illustrated having weight cam 56 assemblies at either uphole and downhole ends of the agitator 12. Thus, upon rotation of the motor 54 within outer housing 44, both cams 56 rotate.

Figure 3:
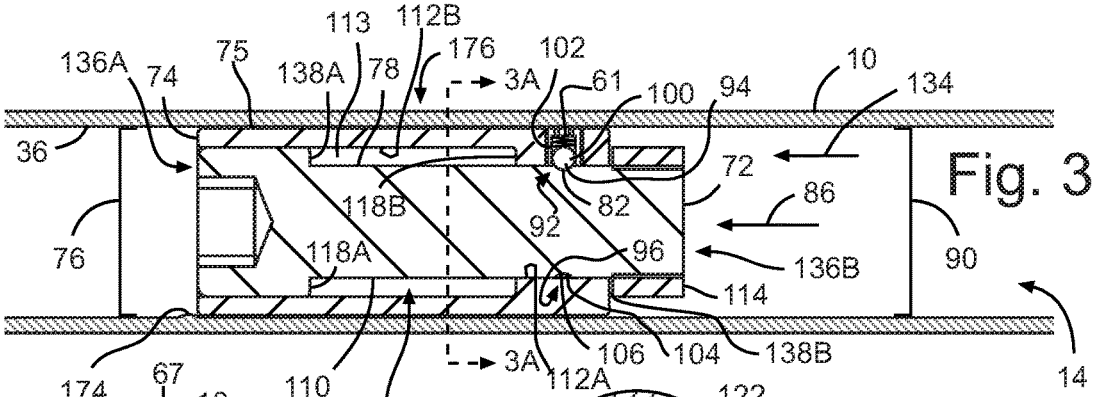
FIGS. 3-4 are a series of cross-section views illustrating a method of checking the inner diameter of a coiled tubing string using a hammer drift tool.

Referring to FIG. 3, the installation of the plurality of agitators 12 may require that the inner wall 36 of the coiled tubing string 10 be a) free of dents and manufacturing defects and/or b) be sized such that the agitators 12 are able to be pumped internally into the desired respective positions 16 in the string 10. Drifting may be performed to ensure that the minimum inside diameter 90 (FIG. 3) of the coiled tubing string 10 is equal to or above a maximum outer diameter 202 (FIG. 6) of the agitator 12. Drifting involves the pushing or pulling of a tool, for example a cylindrical tool 72, of known outside diameter 76 through the coiled tubing string 10. The maximum outside diameter 76 of the tool 72 may be larger than the maximum outside diameter 202 of the agitator 12. In some cases the tool 72 may function as a pig, enlarging any narrow portions or hammering out any dents in string 10 as the tool 72 passes through the string 10.

Figure 4:
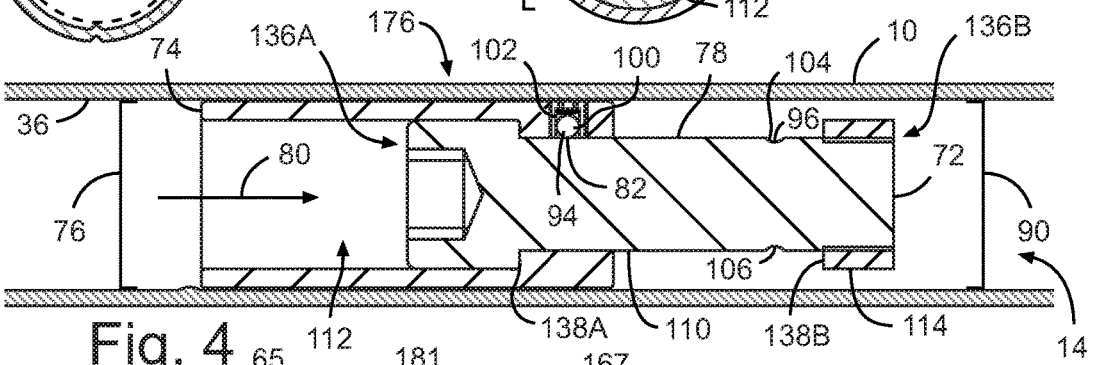

Referring to FIGS. 3 and 4, a hammer drift tool 72 is illustrated comprising an outer housing 74, an inner mandrel 78, cooperating jarring surfaces 118A and 118B (FIG. 3), and a restrictor 82. A maximum outer diameter of an exterior surface 75 of the housing 74 may define a tubing diameter 76 for which the hammer drift tool 72 is sized. The inner mandrel 78 may be disposed telescopically at least partially within the outer housing 74. The cooperating jarring surfaces 118A and 118B on the inner mandrel 78 and outer housing 74, respectively, may be structured for jarring contact with each other when fluid pressure is applied against the inner mandrel 78 in a first direction 80 as shown in FIG. 4. The restrictor 82 may have a structure suitable for restricting initial movement of the inner mandrel 78 relative to the outer housing 74 when fluid pressure is applied to the inner mandrel 78 in the first direction 80. The hammer drift tool 72 may be structured to move, during use, in a second direction 134 through the coiled tubing string 10 when fluid pressure is applied against the hammer drift tool 72 in a second direction 86 opposite the first direction 80. The hammer drift tool 72 may be drifted through the interior 14 of the coiled tubing string 10 to confirm or enlarge an inner diameter 90, for example a minimum inner diameter, of the coiled tubing string 10.

Figure 3A:
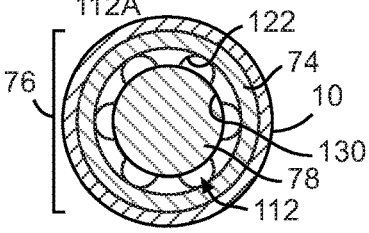
FIG. 3A is a section view taken along the 3A-3A section lines from FIG. 3.

Referring to FIGS. 3, 3A, and 4, the inner mandrel 78 and outer housing 74 may have suitable corresponding structures. A piston shaft 110 of the inner mandrel 78 may be disposed telescopically at least partially within a passageway 112 (such as a cylindrical passageway and cylindrical piston combination) in the outer housing 74. The passageway 112 may be structured to have a piston-receiving part 112A, and a chamber part 112B, with the passageway 112 widening in diameter from the part 112A to 112B, to define a variable fluid chamber 113 between the mandrel 78 and housing 74. The axial ends of the chamber 113 may be formed by the jarring surfaces 118A and 118B, so that as the piston shaft 110 moves in direction 80 through passageway 112, surfaces 118A and 118B approach and contact one another. The fluid chamber 113 may or may not be sealed, although in the example shown the chamber 113 is not sealed as is discussed elsewhere in this document. Also, surfaces 118A and 118B need not be located in a chamber 113, and could be located outside of passageway 112, for example if surface 118B were defined on an axial end of the outer housing 74 (not shown).

Referring to FIGS. 3 and 4, opposed ends 136A and 136B of the piston shaft 110 may have mounted thereon respective flanges 138A and 138B, respectively, to retain or limit movement of the inner mandrel 78 within the passageway 112, for example to permit only limited non-zero axial movement within the passageway 112. Referring to FIGS. 3 and 4, the inner mandrel 78 may have a suitable structure. One or both of the respective flanges 138A and 138B may comprise a nut 114 threaded to a respective one of the opposed ends 136A and 136B of mandrel 78. One of the respective flanges 138A and 138B may form a respective jarring surface of the cooperating jarring surfaces 118A and 118B (FIG. 3).

Referring to FIGS. 3 and 4, the passageway 112 may be structured to bypass fluid during resetting. The inner mandrel 78 may be disposed telescopically at least partially within the passageway 112 in the outer housing 74, and the passageway 112 may be sealed against fluid flow therethrough. An inner wall 122 (FIG. 3A) of the passageway 112 may form a bypass, for example across part 112A of passageway 112, to permit fluid pressure in the second direction 86 to act against the respective jarring surface 118A or 118B of the one of the respective flanges 138A or 138B to reset the inner mandrel 78 from a jarred position (FIG. 4) with the cooperating jarring surfaces 118A and 118B in contact with one another into a neutral or set position 98 (FIG. 3), where the tool 72 is ready to carry out another jar. The bypass 124 may be defined by scalloping about an inner circumference 130 of the outer housing 74, for example as shown in FIG. 3A.

Referring to FIGS. 3 and 4, the restrictor 82 may have a suitable structure. The restrictor 82 may comprise a lock 92 (FIG. 3), for example that is structured to release the inner mandrel 78 upon application of fluid pressure in the first direction 80 against the inner mandrel 78 above a predetermined threshold pressure as shown in FIG. 4. The predetermined threshold pressure may be 200 psi or higher. In some cases the predetermined threshold pressure is between 50 and 500 psi. The restrictor 82 may comprise a male part 94 (FIG. 4), on one of the outer housing 74 or inner mandrel 78, that is biased into contact with a female part 96 (FIG. 4), on the other of the outer housing 74 or inner mandrel 78, when the inner mandrel 78 is in a set position (FIG. 3) prior to ajar movement. The male part 94 may comprise a pin or a ball 100 that is biased (for example via a spring 61) within a radial slot 102 in the outer housing 74 into contact with a pin or ball indent 104 in the inner mandrel 78 when the inner mandrel 78 is in the set position (FIG. 3). The pin or ball indent 104 may comprise a circumferential groove 106, or in some cases a radial opening or hole.

The hammer drift tool 72 may be structured to restrict initial movement into a jar movement via other suitable mechanisms. The restrictor 82 may comprise a shear pin (not shown), that shears at pressures above a predetermined threshold pressure. The outer housing 74 may comprise opposed restriction surfaces (not shown) positioned to set the inner mandrel 78 for a jar movement. Opposed restriction surfaces may involve cooperating cylindrical surfaces, with the restriction surface of the inner mandrel fitting with close tolerance in the restriction surface of the outer housing in the set position, and then upon application of fluid pressure, the inner mandrel moving axially relative to the outer housing to shift the restriction surfaces and build up energy until the restriction surfaces clear one another or a bypass connects fluid from both axial ends of the restriction surfaces, thus dropping resistance to translation and releasing built up energy through a sudden acceleration of the mandrel 78 relative to the housing 74 into a jarring impact between shoulders or surfaces 118A and 118B.

Referring to FIGS. 3 and 4, the hammer drift tool 72 may have a structure suitable for resetting the inner mandrel 78 back to a neutral or set position shown in FIG. 3, where a further jar can be carried out if needed. The restrictor 82 may be structured to reset when fluid pressure is applied against the inner mandrel 78 in the second direction 86 after jarring contact between the cooperating jarring surfaces 118A and 118B (from FIG. 4 to FIG. 3). Drifting may comprise applying fluid pressure against the hammer drift tool 72 in the second direction 86. If the hammer drift tool 72 becomes stuck within the coiled tubing string 10, for example on an obstruction 174, fluid pressure may be applied against the hammer drift tool 72 in the first direction 80 to overcome the restrictor 82 and initiate a jarring contact between the cooperating jarring surfaces 118 as shown in FIG. 4. The mandrel 78 and housing 74 may be provided in a seamed or seamless design. Thus, the drift tool 72 may be re-cocked by circulating in the original conveying direction—forming a slide hammer. Other release mechanisms may be used, such as shear pins, or a drilling jar release mechanism.

Figure 2:
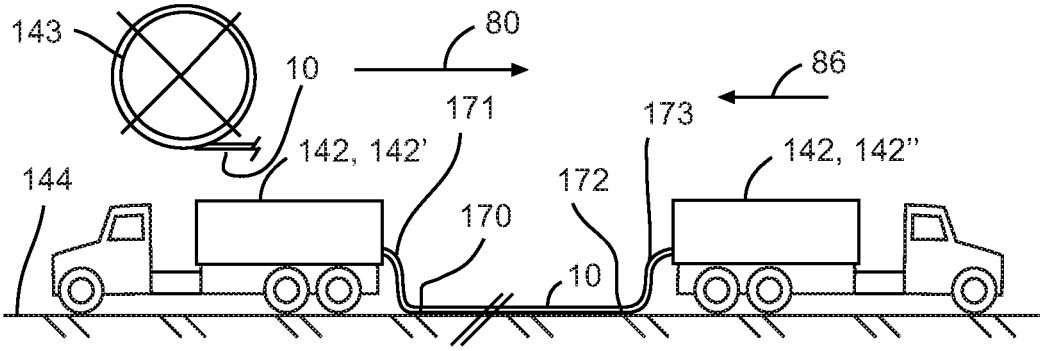
FIG. 2 is a side elevation view of a coiled tubing string disposed in an uncoiled state above a ground surface.

Referring to FIG. 2, a method will be described as an example of how to install agitators 12 within string 10, and how to optionally drift the inner diameter of the string 10 with a hammer drift tool 72. Either method may be practiced without the other method, or the two methods may be combined in sequence. The coiled tubing string 10 or a portion of the coiled tubing string 10 may be supplied from a coiled tubing reel unit 143, straightened, and laid out on a suitable surface such as a ground surface 144. The string 10 may be marked at each agitator intended installation position 16. The string 10 may be fully removed or only partially removed from the unit 143 (and in the latter case the portion remaining on unit 143 may remain there while the method is being carried out, or the portion remaining may be separated, for example cut, from the portion deployed. In some cases portions or all of the methods of drifting and installing agitators may be carried out while the coiled tubing string 10 is in the reel unit 143. A first end 170 of the coiled tubing string 10 may be beveled, for example the coil end inner diameter may be bevelled to 45 degree, and cleaned. A hammer union may be welded to the first end 170 and connected to a pump or a hose 171 of a pressure truck 142'. The hammer union may be removed later prior to downhole use or at another suitable time. The same or a similar process may be carried out on end 172, connecting it to a hose 173 of a second truck 142'. The end 172 may have attached, for example by welding or crimping, a pumping/installation head. As shown in the drawings, the first end 170 and a second end 172 of the coiled tubing string 10 may thus be connected to respective pressure trucks 142' and 142". Once connected to truck 142 or trucks 142, the coiled tubing string 10 may be filled with fluid and pressure tested.

Referring to FIGS. 2 and 3-4, the inner diameter 90 of the coiled tubing string 10 may be confirmed or enlarged via a suitable method. A gauge plug may be pumped toward the reel unit 143 to the desired length of the agitator portion 24 of the string 10. The length may be verified with fluid displacement and density meter readings. The bypass is then opened and the gauge plug pumped out of the coil from the reel unit 143.

Referring to FIG. 3, the hammer drift tool 72 may be used as a gauge plug, or other suitable drift device may be used, for example passed or pumped, for example in the second direction 86, for example towards the coiled tubing reel unit 143, and for example past all intermediate positions 16 or potential agitator installation locations, through the interior 14 of the coiled tubing string 10 to confirm the inner diameter 90 of the coiled tubing string 10. The location of the hammer drift tool 72 may be verified via a sonic meter, density meter, or other suitable device or method, for example measurement of fluid or volumetric displacement. If the hammer drift tool 72 encounters a dent, an obstruction, for example an obstruction 174, or a section of the coiled tubing string 10 having a smaller diameter relative to a previously encountered section of the coiled tubing string 10, the hammer drift tool 72 may fix the obstruction or become stuck.

Referring to FIG. 3, if stuck, the hammer drift tool 72 may be operated to carry out a jar 176 by reversing fluid flow direction in the string 10. Fluid flow may be applied in the direction 80 within the interior 14 of the coiled tubing string 10 to initiate a jarring action. Referring to FIG. 4, application of flow in the direction 80 forces mandrel 78 to move relative to housing 74, overcoming the restrictive resistance to initial movement by restrictor 82 and upon doing so releasing built up energy to accelerate surfaces 118A and 118B together in a jarring action, resulting in the jarred position in FIG. 4. After the jarring action, fluid flow may be applied in the second direction 86 within the interior 14 of the coiled tubing string 10 to reset the jar 176. From FIG. 4, fluid flow is thus applied in direction 86. If the obstruction 174 remains, then the obstruction 174 cannot be cleared and other measures may be taken. The drift tool 72 may then be pumped out of the coiled tubing string 10 via flow in direction 80. If the tool 72 remains stuck after resetting to the set position in FIG. 3, then fluid flow may be reversed again, and fluid flow in direction 80 used to initiate subsequent jars, until the tool 72 hammers out the obstruction 174 or frees itself from the obstruction 174 enough to be removed from the string 10.

If necessary, the coiled tubing string 10 may be repaired to sufficiently enlarge the minimum inner diameter in the event that the minimum inner diameter is too small to facilitate installation of the agitators. A pig or other suitable cleaning device may be pumped towards and away from the first end 170 and the second end 172, respectively, within the coiled tubing string 10 via fluid flow from the pressure trucks 142' and 142". The hammer drift tool 72 itself may be used to hammer out dents in coiled tubing string 10.

Figure 5:
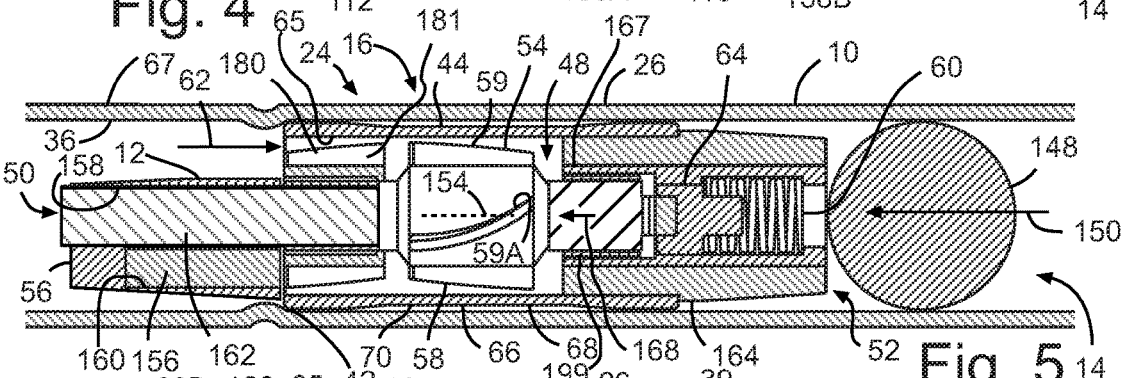
FIGS. 5-6 are a series of partial cross-section views illustrating a method of installing an agitator within a coiled tubing string, with a turbine of the agitator illustrated without sectioning.

Referring to FIGS. 2, and 5-6, an agitator 12 may be conveyed and installed within the coiled tubing string 10 via a suitable method. Conveying and installing the agitator 12 may be carried out while the coiled tubing string 10 is above the ground surface 144. Fluid flow from trucks 142 may be used. Referring to FIG. 5, prior to pumping the agitator 12 into place, a seat or first seat, for example the downhole facing seat 42 (or seat 38 if the fluid pumping direction is reversed), may be formed or installed (for example by crimping) within the interior 14 of the coiled tubing string 10 at the intermediate position 16 between the uphole end 18 (FIG. 1) and the downhole end 20 (FIG. 1) of the coiled tubing string 10. The agitator 12 may be conveyed through the interior 14 of the coiled tubing string 10 (for example with the pumping ball 148) until the agitator 12 sits upon or contacts the downhole facing seat 42.

Conveying may comprise applying fluid flow, for example in a direction 150. A conveying device, such as a plug or ball 148 that is positioned upstream of the agitator 12, may be used to convey the agitator 12 more effectively. The device or ball 148 may form a seal, for example that decreases the amount of fluid bypass across the agitator 12, and thus creates hydraulic action against the agitator 12 where fluid pressure is more effectively converted into agitator 12 motion. A ball 148 or other plug may be used to forms a more uniform seal about the coiled tubing inner diameter, so you can more efficiently pump the agitator 12 in place—without such a plug the agitator 12 may bypass too much fluid to efficiently transport the agitator 12 into place. A relatively low flow rate may be used when the agitator 12 is near the seat 42 to prevent damaging the seat. Once the agitator 12 is in place, the operator may open the bypass and pump out installation ball from coil unit end, or this step could be carried out after the agitator 12 is retained in position.

Referring to FIG. 6, after the agitator 12 is conveyed to the downhole facing seat 42, for example into the intermediate position 16 upon the downhole facing seat 42, a second seat, for example the uphole facing seat 38, may be formed or installed within the interior 14 of the coiled tubing string 10 to secure or retain the agitator 12 between the downhole facing seat 42 and the uphole facing seat 38. The downhole facing seat 42 and the uphole facing seat 38 may be formed by one or both crimping and dimpling an exterior of the coiled tubing string 10. The agitator 12 may be secured against relative axial movement in the string 10. An agitator position sensor (not shown, such as a sonic sensor or a density meter) may be used to confirm that the agitator 12 is in the intermediate position 16. The agitator position sensor may comprise a sonic meter, density meter, or other suitable device, to verify that the agitator 12 is in the correct position. The bypass may be opened and the plug or ball 148 recovered from end 172. The conveying and installation method described above may be repeated for additional agitators 12.

Referring to FIG. 1, the coiled tubing string 10 with installed agitators 12 may be deployed into a well 28 for operations. The string 10 may be supported within the well 28 by a suitable structure such as a drilling rig 146. The coiled tubing string 10 may be inserted within the well 28, for example to drill or ream the well 28. At some point the agitator 12 or agitators 12 may be located within the horizontal or deviated portion 34 of the well 28. The coiled tubing string 10 may be used to drill or ream the well 28 to extend or clean, respectively, the well 28, or to perform any other suitable well operation. The employment of a plurality of agitators 12 spaced along the string 10, for example at 100 m, 200 m, 500 m, or greater intervals, act to reduce friction and increase maximum well depth and formation penetration.

Although described above primarily for coiled tubing use, the apparatuses, systems, and methods described herein may be used with jointed tubing. The agitator 12 may be mounted at the downhole end 20 of the coiled tubing string 10. The agitator 12 may be located within a vertical part of the well 28. The agitator 12 may be mounted or spliced between two segments of coiled tubing. A segment of coiled tubing with one or more agitators 12 already installed within same may be used downhole, or may be spliced to another segment of coiled tubing or threaded to a tubing joint. The agitator 12 may be installed in straight tubing or drill pipe. The uphole facing seat 38 and the downhole facing seat 42 may retain devices and tools other than an agitator within the coiled tubing string 10. The hammer drift tool 72 may be used to hammer out dents in other types of tubing and pipe. The embodiments herein are scalable up or down, to cover all sizes of coiled tubing, tubing and oilfield pipe, including jointed tubing. The hydraulic agitator dimpling/retaining system may be fully adjustable to depth and number of dimples. The retaining system (indents) may secure the agitator 12 in position flowing both directions. The drift tool 72 may be outside of agitator installation, for example to confirm and/or enlarge inner diameter of coiled tubing or jointed tubing in other applications. References to changing or applying fluid pressure in this document may refer to changing or creating fluid flow.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A coiled tubing string comprising an agitator mounted within an interior of the coiled tubing string at an intermediate position between an uphole end and a downhole end of the coiled tubing string; and in which the agitator comprises a plurality of agitators mounted and spaced from one another within the interior of the coiled tubing string at different respective intermediate positions along at least a portion of a longitudinal length of the coiled tubing string;

in which, for each of the plurality of agitators, an inner wall of the coiled tubing string is indented to form a seat upon which the agitator sits;

in which, for each of the plurality of agitators, an outer housing of the agitator contacts the seat in use; and in which, for each of the plurality of agitators, the outer housing comprises a sleeve that defines an exterior of the outer housing, in which an outer diameter of the sleeve narrows at an intermediate cylindrical portion of the sleeve.

2. The coiled tubing string of claim 1 in which, for each of the plurality of agitators, the coiled tubing string is one or both crimped or dimpled to form the seat.

3. The coiled tubing string of claim 1 in which, for each of the plurality of agitators:

the seat is an uphole facing seat;

the inner wall of the coiled tubing string is indented to form a downhole facing seat; and the agitator is retained between the uphole facing seat and the downhole facing seat.

4. The coiled tubing string of claim 1 in which, for each of the plurality of agitators:

the agitator is a fluid-actuated agitator;

the agitator defines a fluid passageway between an uphole end and a downhole end of the agitator; and the agitator has a motor that rotates and vibrates under flow through the fluid passageway.

5. The coiled tubing string of claim 4 in which, for each of the plurality of agitators, the agitator comprises a compressible element that supports the motor and compresses under fluid flow through the agitator in a downhole direction.

6. The coiled tubing string of claim 4 in which, for each of the plurality of agitators, the agitator comprises a thrust bearing assembly that supports the motor.

7. The coiled tubing string of claim 1 in which the coiled tubing string is disposed below ground within a well that penetrates a formation within the earth.

8. The coiled tubing string of claim 7 in which the coiled tubing string forms a drilling string.

9. A method, comprising operating the coiled tubing string of claim 7 within the well to cause the plurality of agitators to vibrate.

10. A coiled tubing string comprising an agitator mounted within an interior of the coiled tubing string at an intermediate position between an uphole end and a downhole end of the coiled tubing string; and in which the agitator comprises a plurality of agitators mounted and spaced from one another within the interior of the coiled tubing string at different respective intermediate positions along at least a portion of a longitudinal length of the coiled tubing string;

in which, for each of the plurality of agitators:

the agitator is a fluid-actuated agitator;

the agitator defines a fluid passageway between an uphole end and a downhole end of the agitator;

the agitator has a motor that rotates and vibrates under flow through the fluid passageway; and in which, for each of the plurality of agitators, the agitator comprises a compressible element that supports the motor and compresses under fluid flow through the agitator in a downhole direction.

11. A coiled tubing string comprising an agitator mounted within an interior of the coiled tubing string at an intermediate position between an uphole end and a downhole end of the coiled tubing string; and in which the agitator comprises a plurality of agitators mounted and spaced from one another within the interior of the coiled tubing string at different respective intermediate positions along at least a portion of a longitudinal length of the coiled tubing string;

in which, for each of the plurality of agitators:

the agitator is a fluid-actuated agitator;

the agitator defines a fluid passageway between an uphole end and a downhole end of the agitator;

the agitator has a motor that rotates and vibrates under flow through the fluid passageway; and in which, for each of the plurality of agitators, the agitator comprises a thrust bearing assembly that supports the motor.

* * * * *